United States Patent [19]

Walsh

[11] Patent Number: 4,981,307

[45] Date of Patent: Jan. 1, 1991

[54] SUSPENSION HARNESS/BODY JACKET ARRANGEMENT

[76] Inventor: Andrew C. Walsh, 12 Stornoway Rd., Cumberland Foreside, Me. 04110

[21] Appl. No.: 335,801

[22] Filed: Apr. 10, 1989

Related U.S. Application Data

[63] Continuation-in-part of Ser. No. 171,328, Feb. 18, 1988.

[51] Int. Cl.[5] ..... A61G 7/10

[52] U.S. Cl. ..... 280/290; 2/44; 2/69.5; 2/311; 2/DIG. 7; 5/81 R; 5/81 C; 5/86; 5/89; 119/96; 128/75; 272/70; 272/70.3; 280/304.1; 297/5; 297/217; 297/DIG. 4

[58] Field of Search ..... 280/304.1, 250.1, 290; 297/DIG. 4, 5, 217; 5/81 R, 81 C, 86, 89; 128/75; 272/70, 70.3; 119/96; 2/311, 44, DIG. 7, 69, 69.5

[56] References Cited

U.S. PATENT DOCUMENTS

| | | | |
|---|---|---|---|
| 2,327,671 | 8/1943 | Rupprecht | 272/70.3 |
| 2,719,568 | 10/1955 | Webb | 2/DIG. 7 |
| 4,141,094 | 2/1979 | Ferguson et al. | 5/81 R |
| 4,530,122 | 7/1985 | Sanders et al. | 5/81 R X |
| 4,635,301 | 1/1987 | Sulser | 2/69 |
| 4,739,526 | 4/1988 | Hollick | 5/89 |

*Primary Examiner*—Mitchell J. Hill

*Attorney, Agent, or Firm*—Nutter, McClennen & Fish

[57] ABSTRACT

A suspension harness/body jacket arrangement adapted for medical applications is disclosed. The harness arrangement suspends all or part of the body weight of a patient with respect to a wheelchair's fixed seat, a bed or the floor. The body jacket is seatless, and fabricated from a mesh or fish net material which elongates and grips the patient more snugly depending upon the tension applied thereto by suspension springs. In the case of incapacitated patients confined to the wheelchair, the arrangement may be used to substantially reduce the pressure applied to the patient's buttocks, thus preventing the development of pressure sores.

17 Claims, 3 Drawing Sheets

SUSPENSION HARNESS/BODY JACKET ARRANGEMENT

RELATED APPLICATION

This is a continuation-in-part of application Ser. No. 07/171,328, filed Feb. 18, 1988, by the same inventor as listed herein.

BACKGROUND OF THE INVENTION

1. Field of the Invention

The present invention relates generally to a suspension harness-body jacket arrangement which is adapted for suspending all or part of a person's weight relative to a rigid support frame. It is useful in a variety of medical applications, for example, for alleviating the conditions which cause pressure sores to develop in persons confined to a wheelchair, for assisting medical personnel in handling and treatment of incapacitated patients, and for aiding incapacitated patients during therapy and recovery.

2. Description of the Prior Art

Nourishment for body tissues, including skin, fat, and muscles, is delivered by blood vessels carrying blood rich in oxygen and nutrients to these tissues. These blood vessels are called arteries, which subdivide into smaller arteries, arterioles and finally capillaries. Exchange takes place at the capillary level with the blood yielding up oxygen and nutrients for the metabolism or nourishment of tissues. Blood vessels which return blood and the waste products of metabolism are called veins. Veins converge into larger veins which convey this blood back to discharge gases and other waste products in a continuous cycle. The pressure on the arterial side of the blood flow averages between 80 and 120 millimeters of mercury.

An average person seated on a hard seat or chair exerts selective pressure on the pelvic buttocks bones, which are known technically as the ischeal tuberosities. Such pressure can reach between 120 and 150 millimeters of mercury. It is a common behavior for a person so seated to shift his or her weight-bearing postural attitude or elect to arise and move about for short periods to relieve such pressure over the bony prominences. The pressure exerted on the bony prominences may variably bear in excess of the arterial pressure, thus tending to deprive the overlying soft tissues of oxygen and nutrients.

The reduction in oxygen and nutrients delivered to the tissues due to excessive pressure activates sensation nerve endings in the affected areas. These nerve endings relay messages to certain areas of consciousness in the brain which are interpreted as discomfort. The sensation of discomfort, depending on the degree and duration of the excessive pressure, tends to cause a shift in the weight-bearing postural attitude, even in sleep, thus preventing devitalisation or damage to the tissues.

Persons who have little or no sensation faculty in certain portions of their bodies due to an injury or the like will not perceive the normal sensory messages of discomfort. As a result, the affected tissues of such persons frequently develop decubitus ulcers or "pressure sores." Pressure sores are a common problem for persons who are confined to a bed or wheelchair, particularly for those suffering from spinal cord injuries. These persons may develop ischeal decubiti (pressure sores on the buttocks) as a result of sitting for a period of time during which excessive pressure bears on the insensitive areas of the buttocks.

One technique for reducing the risk of developing pressure sores is to teach the patient through medical rehabilitation to do frequent pushups while seated in a wheelchair. This is accomplished by placing one's hands on the arms of the wheelchair and pressing downward, thus lifting the torso upward off of the seat. This technique may not be feasible for persons who have difficulty using their arms or are too weak to push themselves up off of the seat.

Another technique for preventing pressure sores the use of cushions or mattresses of varying configurations and materials. These devices operate to more evenly distribute the body weight of a person over the load-bearing surface in order to prevent excessive pressure from being developed. A disadvantage of these devices is that they cannot be easily and quickly adjusted for persons of various weights and sizes.

SUMMARY OF THE INVENTION

The present invention provides a suspension harness/body jacket arrangement, which operates to suspend all or part of a person's weight relative to a fixed support. The harness arrangement includes a support frame, a harness garment or body jacket, and suspension springs. The support frame may be mounted on a wheelchair, mounted to a base member, or otherwise mounted relative to the floor. A patient wears the body jacket around his or her lower torso in the area of the waist. The jacket is connected by shoulder straps and suspension springs to the frame. In this manner, all or part of the patient's body weight may effectively be suspended from the frame. When the arrangement is used with a wheelchair, it suspends the patient relative to the wheelchair's seat, thus substantially lessening pressure on the bony prominences of the buttocks and reducing the likelihood that pressure sores will develop. The frame may also be mounted relative to a bed, and used by medical personnel to aid in handling and treating bed-ridden patients during daily care. Additionally, the frame may be mounted relative to the floor and used to reduce the weight and relieve pain on a patient's back and legs during therapy and related treatments.

According to an important feature of the invention, the body jacket is fabricated from a mesh material which permits the jacket to elongate in response to applied tension. This elongation effect in turn causes the jacket when worn to more snugly fit and evenly bind the patient about his or her waist area. The elongation of the jacket is in response to the tension applied thereto by the suspension spring. Thus, by properly selecting the tension of the suspension springs, the relative degree of suspension of the patient's weight, the elongation of the body jacket, and the snugness of its fit can all be controlled for a given patient and application.

The harness arrangement is particularly useful for individuals with spinal cord injury or disease in the dorsal area of the back. Such persons generally have normal sensation and function in the head and neck, shoulders, arms and hands and are therefore capable of connecting the suspension springs from the body jacket to the frame themselves.

BRIEF DESCRIPTION OF THE DRAWINGS

This invention is pointed out with particularity in the appended claims. The above and further advantages of this invention may be better understood by referring to the following description taken in conjunction with the accompanying drawings, in which:

DETAILED DESCRIPTION OF ILLUSTRATIVE EMBODIMENTS

Figure 1:
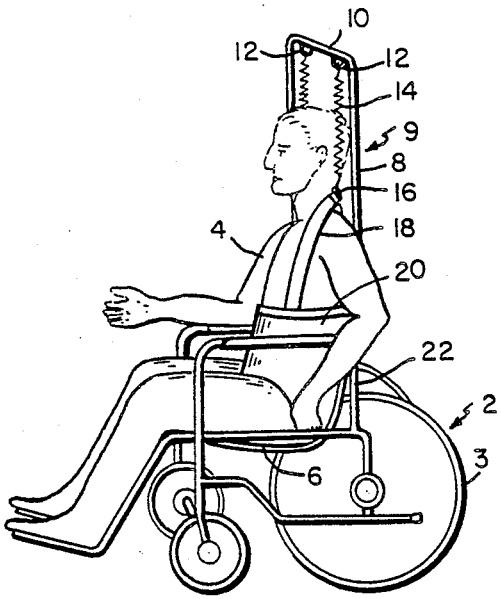
FIG. 1 depicts a patient suspended in a harness arrangement constructed in accordance with the preferred embodiment of the present invention.

FIG. 1 shows a conventional wheelchair 2 in which a patient 4 is riding. The wheelchair 2 includes a fixed seat 6. The rear wheels 3 of the wheelchair 2 are shown as being rearwardly offset with respect to the center of gravity of the wheelchair 2 in order to maintain proper balance. The wheelchair 2 is fitted with an inverted U-shaped support frame 9 which includes two vertical supports 8 and a crossbar 10. The crossbar 10 is fitted with two fastener rings 12. The lower portion of each of the supports 8 are attached to the wheelchair 2 by an adjustable sleeve 22. The patient 4 is wearing a harness garment or body jacket 20 about his torso. Two shoulder straps 18 are connected to the upper part of the jacket 20. A fastener ring 16 slides along each shoulder strap 18. A suspension spring 14 is connected between each fastener ring 16 and its corresponding fastener ring 12.

In general, the harness arrangement shown in FIG. 1 operates to suspend the body weight of the patient 4 with respect to the fixed seat 6. The amount of suspension depends on the weight of the patient and the particular springs which are used. As a result, the pressure which is normally exerted on the patient's buttocks by the seat 6 is substantially reduced or eliminated. As a result, the risk of the patient 4 developing pressure sores is substantially reduced.

Figure 2:
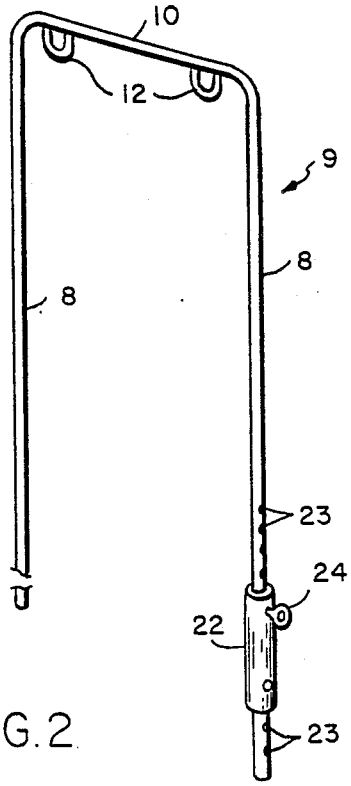
FIG. 2 is an enlarged view of the harness arrangement support frame shown in FIG. 1.
Figure 3:
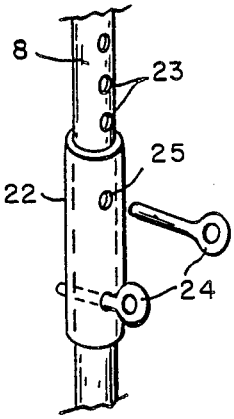
FIG. 3 is an enlarged view of the coupler shown in FIG. 2.

FIG. 2 is an enlarged view of the support frame 9 shown in FIG. 1. The lower portions of the vertical supports 8 include several apertures 23, which extend through the supports. As shown, the lower portions of the vertical supports 8 are normally disposed within the sleeves 22. Referring now to both FIGS. 2 and 3, each of the sleeves 22 includes apertures 25 which are spaced apart so that they may be aligned with a pair of apertures 23. In this fashion, the supports 8 may slide vertically within sleeves 22 until the proper height for the frame is selected, at which time eye bolts 24 may be inserted through apertures 23 and 25 to secure the supports 8.

Figure 4:
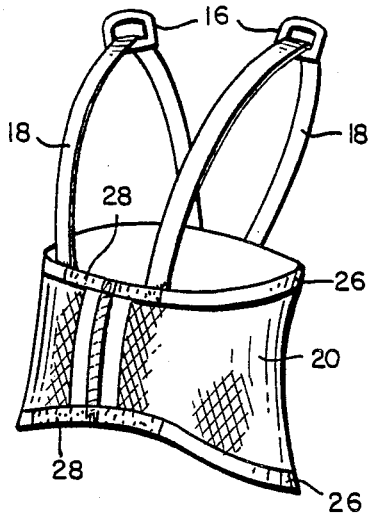
FIG. 4 is a view of the body jacket.

FIG. 4 is an enlarged view of the body jacket 20. The jacket 20 may consist, for example, of a flexible mesh material, similar to a "fish net" fabric. A mesh material permits the jacket 20 when worn to elongate in response to tension applied by the springs 14 to the shoulder straps 18. This elongation effect in turn causes the jacket 20 to fit the wearer more snugly and securely. The jacket 20 is rimmed on its upper and lower portions by reinforced fabric bands or belts 26. The jacket 20 is generally shaped to conform to the contours of a human torso. Closure means 30 permit the jacket 20 to be opened and closed to facilitate its application to and removal from the patient. The closure means 30 may be a zipper, or in the case where adjustability is desired, they may be fastening hooks which are adapted to be engaged in the openings of the mesh material of the jacket 20. In the latter case, the size of the jacket 20 may be adjusted simply by moving the fastening hooks from one set of openings in the mesh material to another. Adjustable straps 28 may be fitted to the upper and lower reinforced fabric bands 26 of the front of the jacket 20 to provide adjustability there as well.

It should be noted that the body jacket 20 has no seat portion contacting the patient's buttocks and thus applies no pressure to that area even when the patient is suspended.

Figure 5:
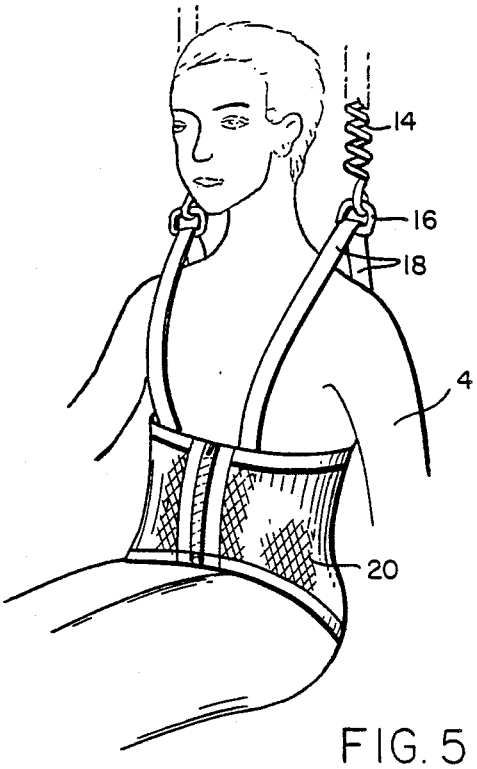
FIG. 5 is a view a person wearing the body jacket shown in FIG. 4.

FIG. 5 is a view of a patient donning the body jacket 20 in the intended manner.

Figure 6:
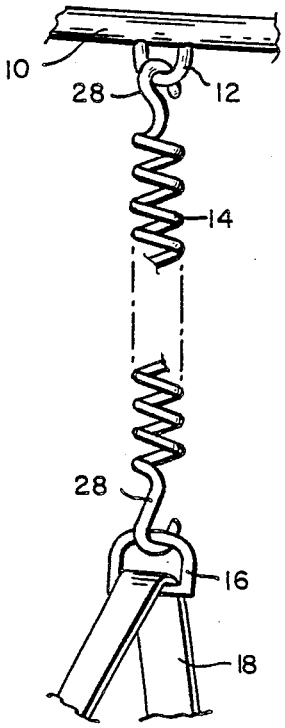
FIG. 6 is an enlarged view of the suspension springs and fasteners shown in FIG. 1.

FIG. 6 is an enlarged view of the springs and fasteners shown in FIG. 1. Each end of the springs 14 includes a blunted hook 28 suitable for connection with a fastener ring 12 or 16.

Figure 7:
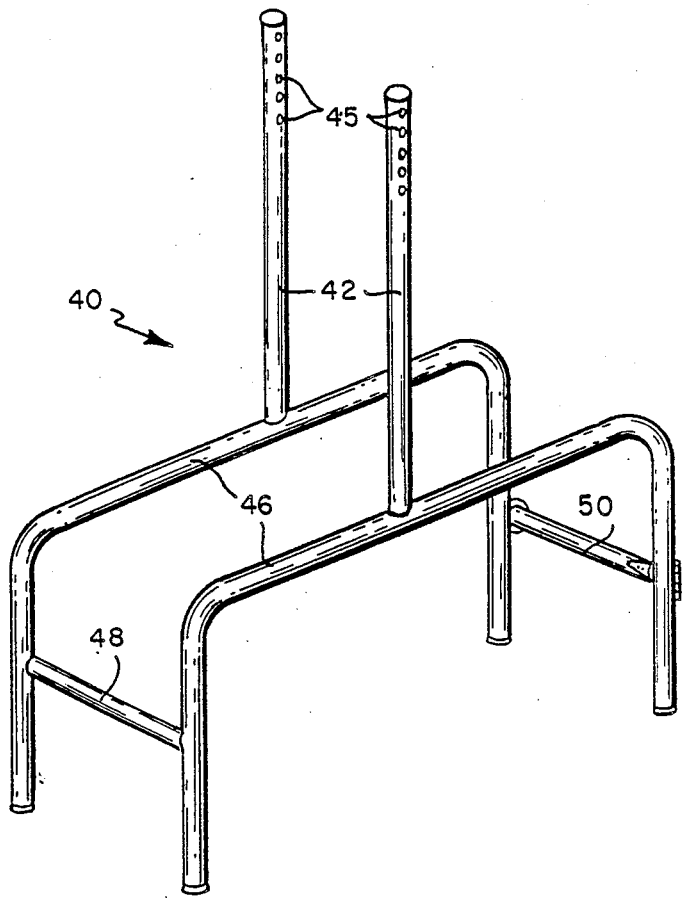
FIG. 7 is a view of a base adapted to support the frame shown in FIG. 2 relative to the floor.

FIG. 7 shows a base 40 adapted to support the inverted U-shaped support frame 9 relative to the floor. The base 40 includes a pair of vertical members 42, having apertures 45 proximate their upper ends and to which the frame 9 may be attached using the adjustable sleeves 22 and eye bolts 24 of FIG. 3. The vertical members 42 are secured to a pair of inverted U-shaped floor members 46 which are secured together by cross members 48 and 50. The cross member 50 may be pivotally attached to one of the members 46 so that it can be opened to provide access to the area between the floor members 46 and later closed. Preferably, the spacing between the floor members 46 is such as to permit the wheelchair 2 to fit in the area therebetween. Thus, the wheelchair 2 may be wheeled into the base 40 to permit the frame 9 to be switched from the base 40 to the wheelchair 2, and vice versa, as desired.

The foregoing description has been limited to a specific embodiment of this invention. It will be apparent, however, that variations and modifications may be made to the invention, with the attainment of some or all of the advantages of the invention. For example, the frame 9 may be made wide enough to straddle a bed and the fastener rings 12 may be adapted to slide longitudinally along the crossbar 10 of the frame 9. In this manner, the patient may be fitted with the body jacket 20 while in the bed and then the patient and fastener rings may be slid laterally relative to the frame 9 to facilitate his or her removal from the bed and placement in the wheelchair 2. Other such variations and modifications will be apparent to those skilled in the art. It is, therefore, the object of the appended claims to cover all such variations and modifications as come within the true spirit and scope of the invention.

What is claimed as new and desired to be secured by Letters Patent of the United States is:

1. A suspension harness apparatus adapted for suspending all or part of a patient's weight relative to a fixed support, said suspension harness apparatus comprising:

frame means including means for attaching one or more suspension means thereto;

harness garment means, said harness garment means adapted to be worn by said patient about his or her lower torso waist area, being seatless and being fabricated from a flexible mesh material, said mesh material being constructed of a fish net-type material such that when a tensile force due to vertical traction is applied to said harness garment means, said mesh material tends to elongate vertically, said elongation causing said garment means to more snugly fit and evenly bind said patient's waist area by applying a gripping force around said patient's waist, said gripping force being sufficient enough to support the weight of said patient, thereby preventing said patient from slipping downward even though said harness garment means does not have a seat for supporting the bottom of said patient, said harness garment means including means for attaching one or more suspension means thereto; and at least one suspension means connectable between said frame means and said harness garment means, said suspension means for selectively applying tension to said harness garment means and for suspending all or part of said patient's body weight with respect to said frame means.

2. The suspension harness apparatus as in claim 1 wherein said frame means further includes a crossbar and two vertical supports, each of said vertical supports having first and second ends, said cross bar being connected between said first ends of said vertical supports, said cross bar having one or more fasteners attached thereto.

3. The suspension harness apparatus as in claim 1 wherein said frame means further includes means for adjusting the height of the frame means.

4. The suspension harness apparatus as in claim 1 wherein said suspension means comprises a spring having a fastener disposed at each end thereof, one of said fasteners adapted to connect to said frame means, the other of said fasteners adapted to connect to said harness garment means.

5. The suspension harness apparatus as in claim 1 wherein said harness garment means further includes one or more shoulder straps.

6. The suspension harness as in claim 1 wherein said harness garment means further includes an upper band of reinforced fabric connected to the mesh material.

7. The suspension harness as in claim 6 wherein said harness garment means further includes a lower band of reinforced fabric connected to the mesh material.

8. A suspension harness apparatus for use with a wheelchair, said wheelchair including a seat on which a person normally sits, said suspension harness apparatus comprising:

A. suspension means for suspending all or part of said person's body weight with respect to said seat;

B. frame means adapted to attach to said wheelchair, said frame means including means for attaching said suspension means thereto, said frame means extending above said seat by a predetermined height; and C. harness garment means including a garment portion adapted to be worn by said person about his or her lower torso waist area, said garment portion being seatless and being fabricated from a flexible mesh material, said mesh material being constructed of a fish net-type material such that when a tensile force due to vertical traction is applied to said garment portion, said mesh material tends to elongate vertically, said elongation causing said garment portion to more snugly fit and evenly bind said person about his or her waist area by applying a gripping force around said person's waist, said gripping force being sufficient enough to support the weight of said person, thereby preventing said person from slipping downward even though said harness garment means does not have a seat for supporting the bottom of said person when said harness garment is suspended by said suspension means relative to said frame means, and said harness garment means further including means for attaching said suspension means to said garment portion whereby said suspension means is connectable between said frame means and said harness garment means.

9. The suspension harness as in claim 8 wherein said garment portion further includes an upper and lower portion of reinforced fabric, said mesh material interposed between and connected to said upper and lower portions.

10. The suspension harness as in claim 8 wherein said garment portion is generally shaped to conform to the contours of a human torso.

11. The suspension harness apparatus as in claim 8 wherein said suspension means comprises spring means connected between said frame means and said harness garment means for tailoring the amount of tension applied to said mesh material.

12. A suspension harness apparatus for use with a wheelchair, said wheelchair including a seat on which a person normally sits, said suspension harness apparatus adapted to suspend the person's body weight with respect to said wheelchair seat while said person remains seated and said wheelchair remains mobile, so as to lessen pressure on selected portions of the buttocks of said person and thereby reduce the likelihood that pressure sores will develop, said suspension harness apparatus comprising:

A. suspension means for suspending all or part of said person's body weight with respect to said seat;

B. frame means adapted to attach to said wheelchair, said frame means including means for attaching said suspension means thereto, said frame means extending above said seat by a predetermined height;

C. harness garment means including a garment portion adapted to be worn by said person about his or her lower torso waist area, being seatless and being fabricated from a flexible mesh material, said mesh material being constructed of a fish net-type material such that when a tensile force due to vertical traction is applied to said garment portion, said mesh material tends to elongate vertically, said elongation causing said garment portion to more snugly fit and evenly bind said person about his or her waist area by applying a gripping force around said person's waist, said gripping force being sufficient enough to support the weight of said person, thereby preventing said person from slipping downward even though said harness garment means does not have a seat for supporting the bottom of said person when said harness garment is suspended by said suspension means relative to said frame means, and means for attaching said suspension means to said garment portion means whereby said suspension means is connectable between said frame means and said harness garment means; and D. said suspension means comprising spring means disposed between said frame means and said harness garment means, said spring means for tailoring the amount of suspension provided by the suspension harness apparatus, and thereby the amount of pressure applied by the wheelchair seat on the buttocks of said person.

13. The suspension harness apparatus as in claim 12 wherein said frame means further includes a crossbar and two vertical supports, each of said vertical supports having first and second ends, said cross bar being connected between said first ends of said vertical supports, said cross bar having one or more fasteners attached thereto, said second ends of said vertical supports being attached to said wheelchair.

14. The suspension harness apparatus as in claim 12 wherein said frame means further includes means for adjusting the predetermined height by which the frame means extends above said fixed seat.

15. The suspension harness apparatus as in claim 12 wherein said attaching means of said harness garment means includes one or more shoulder straps.

16. A harness garment for use with suspension harness apparatus,

A. said suspension harness apparatus adapted for suspending a person and comprising (1) suspension means for suspending all or part of said person's body weight with respect to means on which said person is disposed;

(2) frame means adapted to attach to said means on which said person is disposed, said frame means including means for attaching thereto and supporting therefrom said suspension means, said frame means extending by a predetermined height above said means on which said person is disposed; and B. said harness garment means including (1) a portion adapted to be worn by said person about his or her lower torso waist area, said portion being seatless and being fabricated from a flexible mesh material, said mesh material being constructed of a fish net-type material such that when a tensile force due to vertical traction is applied to said portion, said mesh material tends to elongate vertically, said elongation causing said portion to more snugly fit and evenly bind said person about his or her waist area by applying a gripping force around said person's waist, said gripping force being sufficient enough to support the weight of said person, thereby preventing said person from slipping downward even though said harness garment means does not have a seat for supporting the bottom of said person when said harness garment is suspended by said suspension means relative to said frame means, and (2) means for attaching said suspension means to said portion, whereby said suspension means is connectable between said frame means and said attaching means of said harness garment means.

17. The suspension harness apparatus as in claim 16 wherein said frame means includes on upper portion associated with said suspension means, and a lower base portion adapted to be supported on the floor, said upper portion being removably attachable to said lower base portion of said frame means.

* * * * *